US005702333A

United States Patent [19]

Waldron et al.

[11] Patent Number: 5,702,333

[45] Date of Patent: Dec. 30, 1997

[54] METHOD OF SAFELY STRETCHING AND STRENGTHENING THE LUMBAR SPINE AND LUMBAR MUSCLES

[76] Inventors: David W. Waldron, 221 Anderson Pl., Buffalo, N.Y. 14222; Richard J. Waldron, 257 Ethel, Mill Valley, Calif. 94941

[21] Appl. No.: 599,172

[22] Filed: Feb. 9, 1996

Related U.S. Application Data

[62] Division of Ser. No. 412,446, Mar. 29, 1995.

[51] Int. Cl.[6] ..... A63B 23/02

[52] U.S. Cl. ..... 482/131; 482/132; 482/907; 601/23

[58] Field of Search ..... 482/51, 131, 132, 482/140, 142, 146, 907; 273/449; 472/135; 297/270.1, 270.5, 271.5, 271.6, 272.1; 601/23, 24; 606/240–242

[56] References Cited

U.S. PATENT DOCUMENTS

| | | | |
|---|---|---|---|
| 4,307,880 | 12/1981 | Abram | 482/142 |
| 4,523,583 | 6/1985 | Noble | 606/241 |
| 4,752,067 | 6/1988 | Colonello | 482/140 |
| 4,838,249 | 6/1989 | Jannotta | 606/241 |

OTHER PUBLICATIONS

"The Lumbar Spine Mechanical Diagnosis and Thery" R. A. Mckenzie 1981 pp. 56–63.

"Treat Your Own Back", Robin McKenzi, 1985 p. 69.

*Primary Examiner*—Jeanne M. Clark

*Attorney, Agent, or Firm*—Nixon & Vanderhye P.C.

[57] ABSTRACT

An exercise method beneficially and safely affects the lumbar spine and muscles of a human. The method uses a simple exercise device having a substantially rigid body with top and bottom surfaces, and a front and back. The top surface is configured and dimensioned to safely passively extend a human's lumbar spine when the human lays with her or his stomach on the top surface (e.g. by providing a concave surface with a total angle of concavity of about 10°–30°, preferably about 12°–17°). The bottom surface of the device is configured and dimensioned to allow rocking action in a dimension extending from the front to the rear of the device, and may include two or more spaced rocking strips with front and rear stops. In addition to passively laying on the top surface, the human may occasionally contract her or his lumbar muscles and rock her or his body toward and away from the front of the device to effect rocking action of the device, which assists in strengthening the lumbar musculature and promoting stability of her or his back. The method of use also may include the user pushing on the surface on which the device bottom surface is positioned with her or his arms to move her or his chest away from the top surface of the device while the thighs remain in contact with the top surface, and hold that position for at least a few seconds, so as to passively stretch the front of her or his spine.

17 Claims, 3 Drawing Sheets

Fig. 4
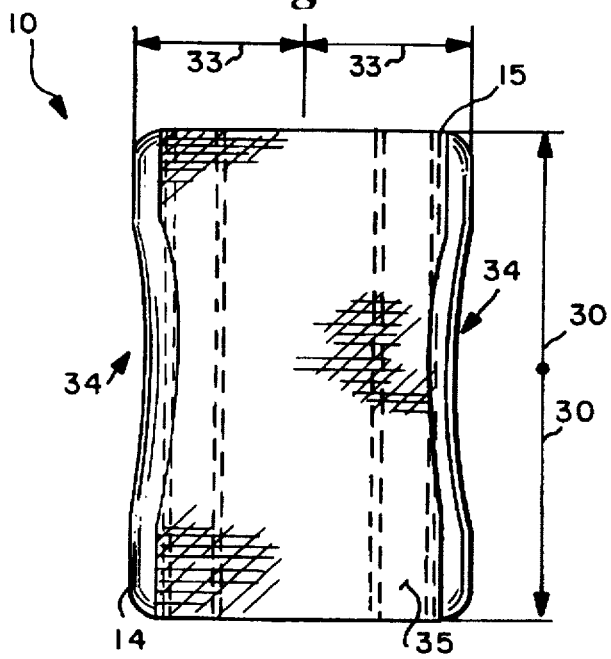
Fig. 2
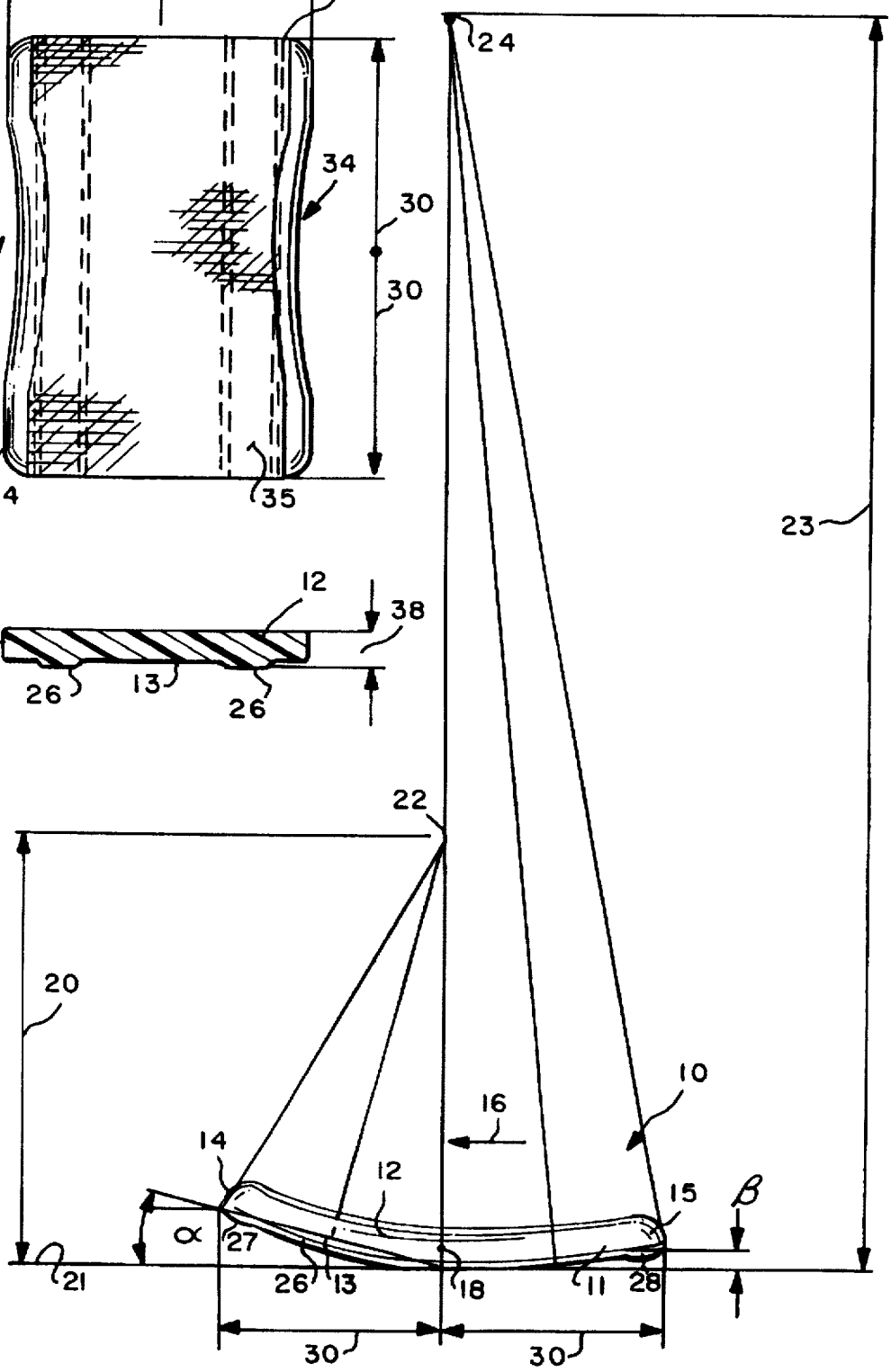
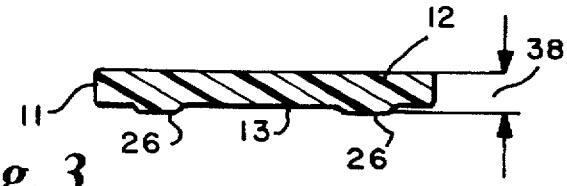
Fig. 3

METHOD OF SAFELY STRETCHING AND STRENGTHENING THE LUMBAR SPINE AND LUMBAR MUSCLES

This is a divisional of application Ser. No. 08/412,446 filed Mar. 29, 1995.

BACKGROUND AND SUMMARY OF THE INVENTION

Back pain or dysfunction will afflict 80% of the human population at some point in their lives. One presumed cause of back injury and dysfunction stems from poor posture, the loss of lumbar lordosis, the curve in the low back, or the ability to bend backward. Also a common cause of back injury and pain is a low back strain of the muscles and ligaments in the back due to a lack of strength of the back muscles.

There are numerous apparati designed to strengthen muscles in and around the pelvic girdle, more specifically machines to strengthen abdominal muscles, which are also important to maintain a healthy low back. Also there are numerous exercises, techniques, and theories regarding prevention and intervention for low back pain and dysfunction. However, there appears to be no simple device or procedure effective to: (i) place the lumbar spine in a passively extended position at the outset allowing posteriorly stretched or strained structures to come closer together and allow for these structures to become thicker and stronger; (ii) stretch anterior structures on the front of the spine often shortened with poor posture and a forward flexed lifestyle; and (iii) assist in the strengthening of the lumbar musculature which will assist in promoting stability around the low back.

The invention relates to an exercise device, and method of exercising using the device, in which all three of the above affects (i)–(iii) will take place while the user is in a comfortable and natural prone or stomach lying position. The user will readily be able to stretch tight anatomical interior structures affecting the lumbar spine, position the lumbar spine in a passive back bend or extension, and assist in the strengthening of low back or lumbar muscles all of which promote proper maintenance and care of the lumbar spine and may also be used as part of a plan to assist in the correction of spinal strain and dysfunction brought on by the loss of the lumbar curve or extension, and the loss of integrity in the posterior spinal support structure resulting from repeated forward bending with or without a load.

According to one aspect of the present invention an exercise device is provided comprising the following components: A substantially rigid body having a top surface concave in at least one dimension, a bottom surface, a front and a back, the at least one is dimension extending from the front to the back. The top surface having a total angle of concavity of about 10°–30°. And, the body having a length, from front to back, less than about six feet and more than about 18 inches.

The body typically has a center point in the at least one dimension of concavity, and a first angle of concavity from approximately the center point to the front of the device of about 7°–20°, and a second angle of concavity from approximately the center point to the rear of about 3°–10°, the first angle being larger than the second angle by at least 2°. Preferably the top surface is concave in only one dimension, not being significantly concave in another dimension transverse to the one dimension, and the bottom surface comprises a convex surface substantially parallel to the top surface and providing for rocking action of the body when engaging a substantially flat support surface.

The total angle of concavity is preferably about 10°–20°, more preferably about 12°–17°, and optimally about 15°. The body length is typically between 24–42 inches, and several different sizes may be provided to accommodate humans of different heights and bulk. The body has a width of about 18–30 inches, typically about two feet, and must be of a material rigid enough to support the weight of a human using it without breaking it or deflection of more than a degree or so. For example the body may be an integral piece of plastic. Padding may be disposed on the top surface, and at least two spaced rocking strips may be provided extending outwardly from the bottom surface. Rocking stops may be provided on the bottom surface adjacent the front and rear of the body.

The invention also relates to an exercise device for beneficially and safely acting on a human's lumbar spine. The exercise device comprises: A body of substantially rigid material having top and bottom surfaces, a front, and a rear. The top surface configured and dimensioned to passively and safely extend a human's lumbar spine when the human lays with his or her stomach on the top surface and his or her head facing the front and legs the rear of the body. And, the bottom surface configured and dimensioned to allow rocking action of the body between positively stopped limits that are less than about 30° when the human laying on the top surface actively contracts his or her lumbar muscles and moves his or her body backward and forward, toward and away from the front and rear. The details of the exercise device body are as described above.

The invention also relates to a method of beneficially and safely affecting the lumbar spine of a human and utilizing a device having a top surface configured and dimensioned to safely passively extend a human's lumbar spine when the human lays with her or his stomach on top surface, and a bottom surface supported by a support surface, which allows rocking action in a dimension extending from the front to the rear of the device. The method comprises the steps of: (a) A human occasionally laying with her or his stomach on the top surface, with at last part of her or his chest and thighs supported by the top surface so that the lumbar spine is in a passively extended position allowing lumbar muscles to become thicker and stronger. And, (b) the human occasionally contracting her or his lumbar muscles and rocking her or his body toward and away from the front of the device to effect rocking action of the device which assists in strengthening of her or his lumbar musculature promoting stability of her or his back.

Method steps (a) and (b) are typically practiced with the human placing his or her lumbar level three at about the center of gravity of the device. There is also preferably the further step (c) of the human occasionally pushing on the surface on which the device bottom surface is positioned with her or his arms to move her or his chest away from the top surface of the device while the thighs remain in contact with the top surface of the device, and hold that position for at last a few seconds, so as to passively stretch the front of her or his spine.

It is the primary object of the present invention to provide a simple yet effective device and method of utilization thereof which will safely beneficially affect a human's lumbar spine and muscles. This and other objects of the invention will become clear from an inspection of the detailed description of the invention and from the appended claims.

BRIEF DESCRIPTION OF THE DRAWINGS

FIG. 2 is a side view of the device of FIG. 1 showing various angles and dimensions associated therewith;

FIG. 3 is a transverse cross-sectional view of the device of FIGS. 1 and 2 (with padding removed);

FIG. 4 is a top plan view of the device of FIG. 2;

DETAILED DESCRIPTION OF THE DRAWINGS

Figure 1:
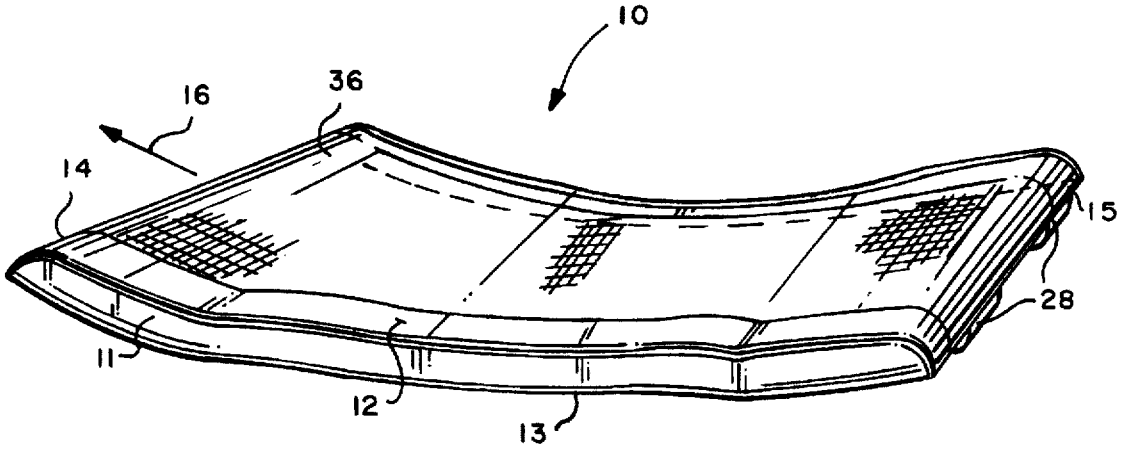
FIG. 1 is a top perspective view of an exemplary exercise device according to the present invention.

An exercise device according to the present invention is shown generally by reference numeral 10 in the drawings. The device 10 comprises a body 11 of substantially rigid material having a top surface 12 and a bottom surface 13, a front 14, and a rear 15. The term "substantially rigid body" as used in the present specification and claims means that the body 11 has sufficient rigidity so that it will not deflect more than a few degrees during the normal utilization thereof as an exercise device. The device 10 typically is able to withstand the forces exerted during normal use by a human having a weight of about 250 lbs.

The top surface 12 is concave in at least one dimension as indicated by the dimensional arrow 16 in FIG. 1, and preferably is concave only in the dimension 16 (that is not in the dimension transverse to the dimension 16). The total angle of concavity of the top surface 12 is preferably between about 10° to 30°. Ten degrees is about the minimum angle at which a human can lie in a passively extended position in which there is a benefit to laying in that position, in which the human's lumbar spine is passively extended an amount sufficient to provide beneficial action. Thirty degrees is approximately the maximum backward deflection that the human body can assume. The desired angle of concavity is between about 10°–20°, the optimum about 12°–17° (e.g. 15°).

FIG. 2 illustrates the preferred manner in which the desired concavity is obtained. In FIG. 2 the body 11 is shown having an approximately mid point 18 in the dimension 16 (between the front 14 and rear 15 of the body 11), the surface 12 having two different angles of concavity on opposite sides of the mid point 18. For example the angle of the surface 12 from the mid point 18 to the front 14 is indicated by angle $\alpha$ in FIG. 2, which preferably is about 7°–20°, most desirably about 10° to 15°. The angle of the surface 12 from the mid point 18 back to the rear 15 is indicated by angle $\beta$ in FIG. 2, and is between about 3°–10°, typically about 5°. For example, as illustrated in FIG. 2, the distance 20 between a tangent line 21 to the bottom surface 13 at the mid point 18 and the center 22 about which the surface 12 is arced is about three feet, whereas the distance 23 between the tangent line 21 and the center 24 is about eight feet.

The bottom surface 13 is preferably convex, and substantially parallel to the surface 12, as clearly illustrated in FIG. 2. In order to facilitate rocking action of the device 10, at least two spaced rocking strips 26 (see FIGS. 2 and 3) are provided which extend from the front 14 to the rear 15, the strips 26 extending outwardly from the bottom surface 13. Also stops are provided for positively stopping the rocking action, such as the front stop 27 (see FIG. 2) and the rear stop 28 (see FIGS. 1 and 2).

Figure 5:
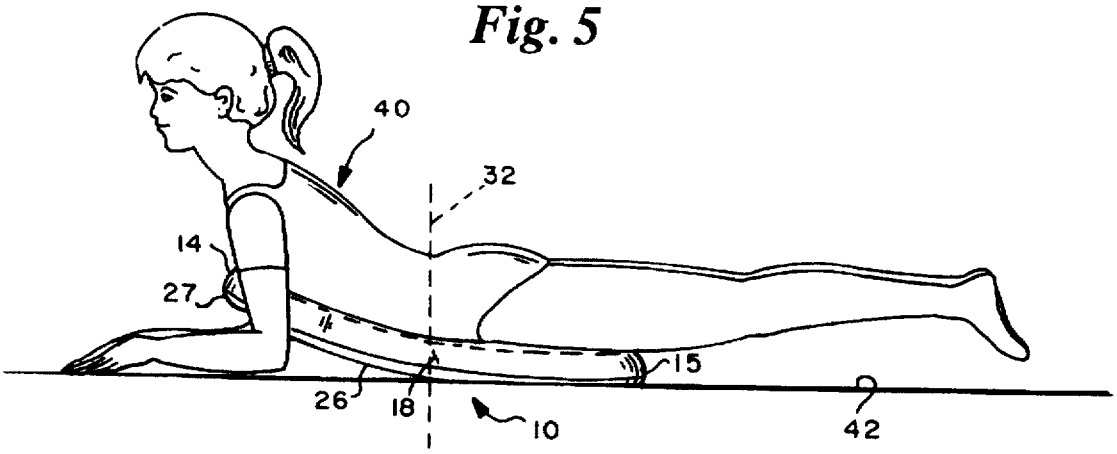
FIG. 5 is a side schematic view illustrating one manner of utilization of the device of FIGS. 1 through 4.

The device 10 is typically dimensioned so that the lengths 30 along the tangent line 21 from the front 14 to the mid point 18, and from the rear 15 to the mid point 18, are approximately equal, and that the two lengths 30 together are between about 24–42 inches, and in any event less than about six feet (and preferably less than the height of a human using it and more than about eighteen inches) so that the device 10 is mobile and practical. The total length (twice the length 30) is preferably long enough to at least partially support the chest and thighs of a user (as seen in FIG. 5) when the user passively lays on the surface 12 with her or his third lumbar level at approximately the center of gravity (e.g. mid point 18) of the device 10, as indicated by the line 32 in FIG. 5. More than one different size of the device 10 may be provided for people of significantly different heights, for example a 24 inch length (twice 30) for relatively short people, and a 42 inch length for relatively tall people.

Figure 6:
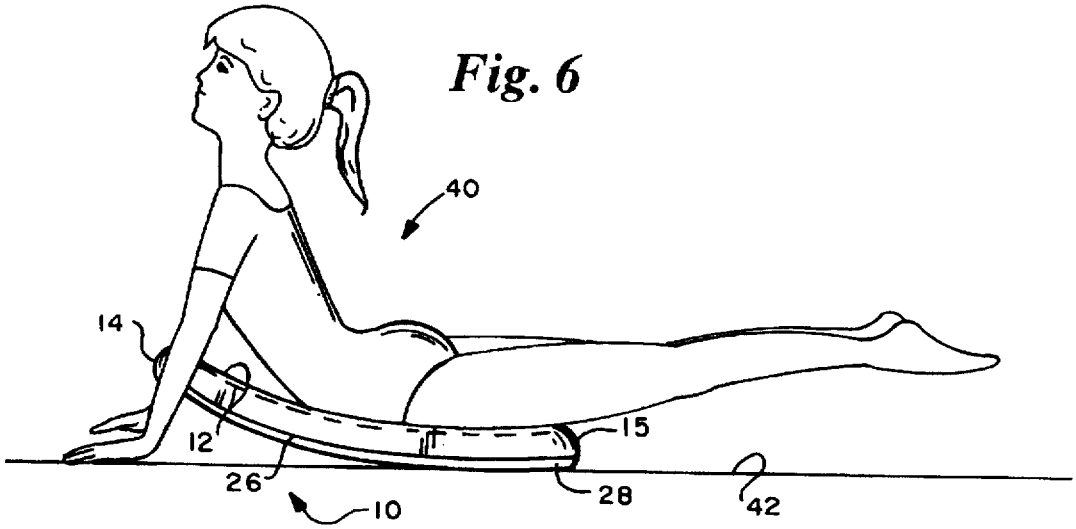
FIG. 6 is a view like that of FIG. 5 showing a second exemplary manner of utilization of the device.
Figure 7:
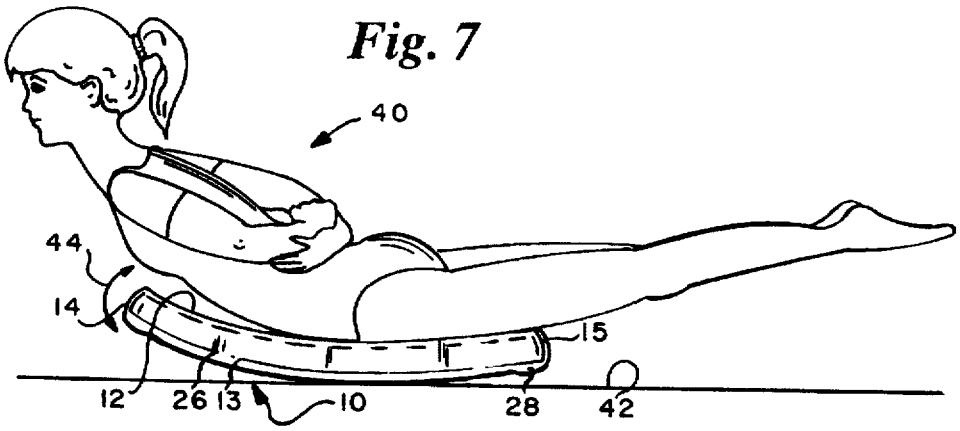
FIG. 7 is a view like that of FIG. 5 showing a third exemplary manner of utilization of the device.

The width of the device 10 is typically about 18–30 inches (e.g. about two feet), as shown in FIG. 4 by the two different halves of the width, each half being indicated by reference numeral 33. The width (twice 33) is preferably wide enough to positively support the human user's pelvis, as seen in FIGS. 5 through 7, but narrow enough so that the human user can straddle the device 10 with his or her arms (as illustrated in FIG. 6). While FIG. 4 illustrates an inward curvature 34 on both sides of the device 10 (between the ends 14, 15), the curvature 34 is primarily aesthetic.

In order to provide comfort for the user of the device 10, padding—see 36 in FIGS. 1 and 4—may be provided covering at least that portion of the top surface 12 which is likely to engage the user's body. The padding 36 may be of any conventional type such as foam, cloth, webbing, mesh, or the like and it may be affixed to the top surface 12 in any desired manner, such as by snaps (not shown), adhesive acting between the bottom of the padding 36 and the top surface 12, or in any other manner that can successfully hold the padding 36 in place during use of the device 10 for performing exercises as are hereafter described.

The thickness of the body 11, without the padding 36, is indicated by reference numeral 38 in FIG. 3, and is not particularly critical, as long as the body 11 has the sufficient rigidity and other properties. Typically the thickness 38 is on the order of about 4 inches (e.g. 3 inches).

The body 11 itself may be made out of any suitable material. For example it could be wood or metal, but most desirably is a hard plastic, most desirably an integral (except for padding 36) piece of plastic. While the body 11 is typically solid, where the properties of the material of which it is made are suitable for that purpose, the surfaces 12, 13 can have through-extending perforations, or the surfaces may be mesh, embossed, dimpled, scalloped, screen-like, or otherwise configured either to save weight and expense, or for enhanced properties.

The device 10 may be used safely in at least three different manners to effect different desired results. FIG. 5 illustrates common passive use of the device 10 in which a human user 40 lays with her stomach on the top surface 12 with L3—as indicated by line 32—at the approximate mid point 18 so that a significant part of the user 40's chest is supported by the surface 12 between the mid point 18 and the front 14, and a substantial part of her thighs are supported by the top surface 12 between the mid point 18 and the rear 15. In the FIG. 5 position the lumbar spine of the human 40 is passively extended, an amount equal to the total angle of concavity of the surface 12 (that is between about 10°–20°, preferably about 17° as illustrated in FIG. 5). This passive extension of the lumbar spine allows posteriorly stretched or strained structures to come closer together and allow for those structures to become thicker and stronger.

FIG. 6 illustrates another manner of utilization of the device 10. When the device is used as illustrated in FIG. 6, the human 40 places her hands on the support surface 42 for the rocking strips 26 on either side of the front 14 of the device 10 and pushes her chest off of the top surface 12, while her thighs remain in contact with the top surface 12 (as seen in FIG. 6). The human 40 then holds the position illustrated in FIG. 6 for at least a few seconds, and may move up and down between the position illustrated in FIG. 6 and that illustrated in FIG. 5. This results in—especially when the position of FIG. 6 is held—passively stretching the front of the human 40's spine.

FIG. 7 illustrates yet another manner of safely and effectively utilizing the device 10 for the benefit of the user's back. In the position illustrated in FIG. 7 the human 40 contracts her lumbar muscles to raise her chest and/or thighs off (at least partially off) the surface 12, and shifts her center of gravity frontwards and backwards to effect a rocking action. The rocking action is stopped if the stops 27 or 28 engage the support surface 42. The rocking action is illustrated schematically by arrow 44 in FIG. 7. In this manner the human 40 strengthens her lumbar musculature, which assists in promoting stability around the lower back.

It will thus be seen that according to the present invention a simple to construct and use, relatively inexpensive, yet effective exercise device is provided which beneficially affects the human user's lumbar spine to overcome low back pain and dysfunction in a number of situations, or to prevent it for the future. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of beneficially and safely affecting the lumbar spine of a human, comprising the steps of:

(a) providing a substantially rigid device having a concavely curved top surface her or and a curved bottom surface, supported by a support surface, which allows rocking action in a dimension extending from the front to the rear of the device, the length of the device between the front and the rear ranges from about 18 inches to less than six feet whereby the top surface is configured and dimensioned so as to allow the human to safely passively extend his or her spine when the human lays with his or her stomach on the top surface;

(b) a human occasionally laying with her or his stomach on the top surface, with at last part of her or his chest and thighs supported by the top surface and her or his face extending past the front of the device, so that the lumbar spine is in a safely passively extended position allowing lumbar muscles to become thicker and stronger; and (c) the human occasionally contracting her or his lumbar muscles and rocking her or his body toward and away from the front of the device to effect rocking action of the device, which assists in strengthening of her or his lumbar musculature promoting stability of her or his back.

2. A method as recited in claim 1 wherein steps (a) through (c) are practiced with the human placing her or his lumbar level 3 at about the center of gravity of the device.

3. A method as recited in claim 2 comprising the further step of positively limiting the rocking action of the device from the forward to backward positions during the practice of step (c) so that it is less than about 30°.

4. A method as recited in claim 2 comprising the further step (d) of the human occasionally pushing on the support surface with her or his arms to move her or his chest away from the top surface of the device while keeping her or his thighs in contact with the top surface of the device and her or his legs off the support surface, and hold that position for at least a few seconds, so as to passively stretch the front of her or his spine.

5. A method as recited in claim 2 wherein step (a) is practiced by providing a total angle of concavity of the top surface of between about 10°–30°.

6. A method as recited in claim 1 comprising the further step (d) of the human occasionally pushing on the support surface with her or his arms to move her or his chest away from the top surface of the device while keeping her or his thighs in contact with the top surface of the device and her or his legs off the support surface, and hold that position for at last a few seconds, so as to passively stretch the front of her or his spine.

7. A method as recited in claim 6 comprising the further step of positively limiting the rocking action of the device from the forward to backward positions during the practice of step (c) so that it is less than about 30°.

8. A method as recited in claim 6 wherein step (a) is practiced by providing a total angle of concavity of the top surface of between about 10°–30°.

9. A method as recited in claim 6 wherein step (a) is practiced by providing padding on the top surface of the device; and wherein steps (b) and (c) are practiced with the human having her or his stomach and at least part of her or his chest or thighs in contact with the padding.

10. A method as recited in claim 9 comprising the further step of positively limiting the rocking action of the device from the forward to backward positions during the practice of step (c) so that it is less than about 30°.

11. A method as recited in claim 1 comprising the further step of positively limiting the rocking action of the device from the forward to backward positions during the practice of step (c) so that it is less than about 30°.

12. A method as recited in claim 1 wherein step (a) is practiced by providing a total angle of concavity of the top surface of between about 10°–30°.

13. A method as recited in claim 12 wherein step (a) is practiced by providing padding on the top surface of the device; and wherein steps (b) and (c) are practiced with the human having her or his stomach and at least part of her or his chest or thighs in contact with the padding.

14. A method as recited in claim 1 wherein step (a) is practiced by providing a total angle of concavity of the top surface of between about 12°–17°.

15. A method as recited in claim 14 wherein step (a) is practiced by providing padding on the top surface of the device; and wherein steps (b) and (c) are practiced with the human having her or his stomach and at least part of her or his chest or thighs in contact with the padding.

16. A method as recited in claim 1 wherein step (a) is practiced by providing padding on the top surface of the device; and wherein steps (b) and (c) are practiced with the human having her or his stomach and at least part of her or his chest or thighs in contact with the padding.

17. A method as recited in claim 16 comprising the further step of positively limiting the rocking action of the device from the forward to backward positions during the practice of step (c) so that it is less than about 30°.

* * * * *